United States Patent [19]

Ulf

[11] Patent Number: 4,731,036

[45] Date of Patent: Mar. 15, 1988

[54] INDICATOR MEANS

[76] Inventor: Ericstam Ulf, Stureplatsen 2, S-411 39, Göteborg, Sweden

[21] Appl. No.: 852,247

[22] PCT Filed: Jul. 4, 1985

[86] PCT No.: PCT/SE85/00270

§ 371 Date: Mar. 19, 1986

§ 102(e) Date: Mar. 19, 1986

[87] PCT Pub. No.: WO86/00861

PCT Pub. Date: Feb. 13, 1986

[30] Foreign Application Priority Data

Jul. 26, 1984 [SE] Sweden ..... 8403866

[51] Int. Cl.[4] ..... B63B 22/00; G01D 5/12

[52] U.S. Cl. ..... 441/2; 441/6; 441/23; 441/27; 116/204; 24/602

[58] Field of Search ..... 441/2, 6, 7, 10, 23, 441/24, 25, 26, 27; 116/204, 209, 228; 24/602

[56] References Cited

U.S. PATENT DOCUMENTS 3,419,927 1/1969 Stoffer et al. ..... 441/7

*Primary Examiner*—Joseph F. Peters, Jr.
*Assistant Examiner*—Thomas J. Brahan
*Attorney, Agent, or Firm*—Balogh, Osann, Kramer, Dvorak, Genova & Traub

[57] ABSTRACT

A device for indicating the presence in water of an object consisting of material capable of being affected by a magnet, the device containing a magnet. The device enables a reliable and effective indication to be given of metallic objects which are present in water. The magnet exhibits an active surface capable of interacting with the object in question and a floating body connected to the magnet in such a way as to be capable of being released from it, in conjunction with which there is present at least one ejector protrusion projecting beyond the active surface in question, so arranged that the ejector protrusion will endeavour, because of the nature of the interaction between the ejector protrusion and the object in question, to break the bond between the magnet and the floating body when the magnet is affected by the object in question.

18 Claims, 6 Drawing Figures

INDICATOR MEANS

The present invention relates to a device for indicating the presence in a fluid of an object consisting of material capable of being affected by a magnet, the device containing a magnet.

The principal object of the present invention is primarily to make available a device of the aforementioned kind which is simple and which permits the location and marking of a position of magnetisable metal objects in water beneath the surface of the water.

This object is achieved by a means of the aforementioned nature, which is characterized essentially in that a magnet exhibits an active surface capable of interacting with the submerged object and a floating body connected to the magnet in such a way as to be capable of being released from it, in conjunction with which there is present at least one ejector protrusion projecting beyond the active surface, so arranged that the ejector protrusion will endeavour, because of the nature of the interaction between the ejector protrusion and the object in question, to break the holding effect between the magnet and the floating body when the magnet is affected by the object in question.

The invention is described below as a number of preferred typical embodiments, in conjunction with which reference is made to the accompanying drawings, of which:

Figure 1:
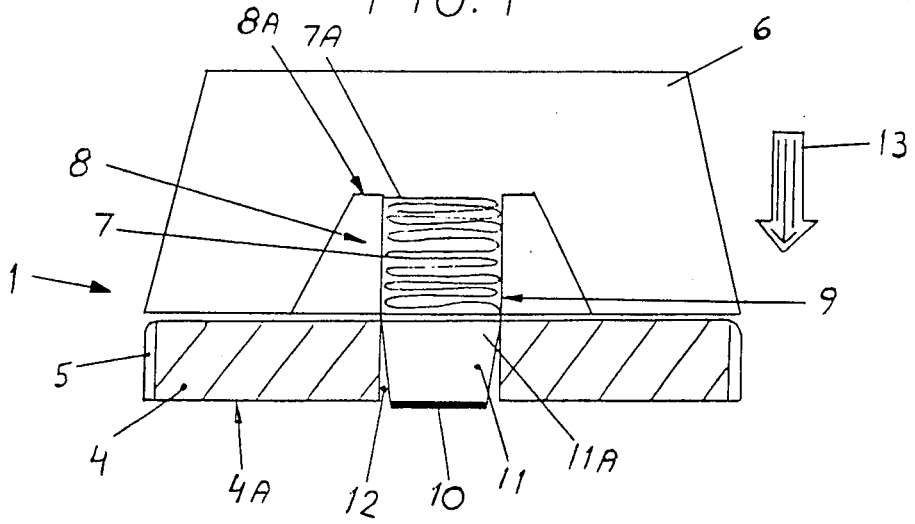
FIG. 1 shows a section through a first variant of an indicator device in the loaded state.
Figure 2:
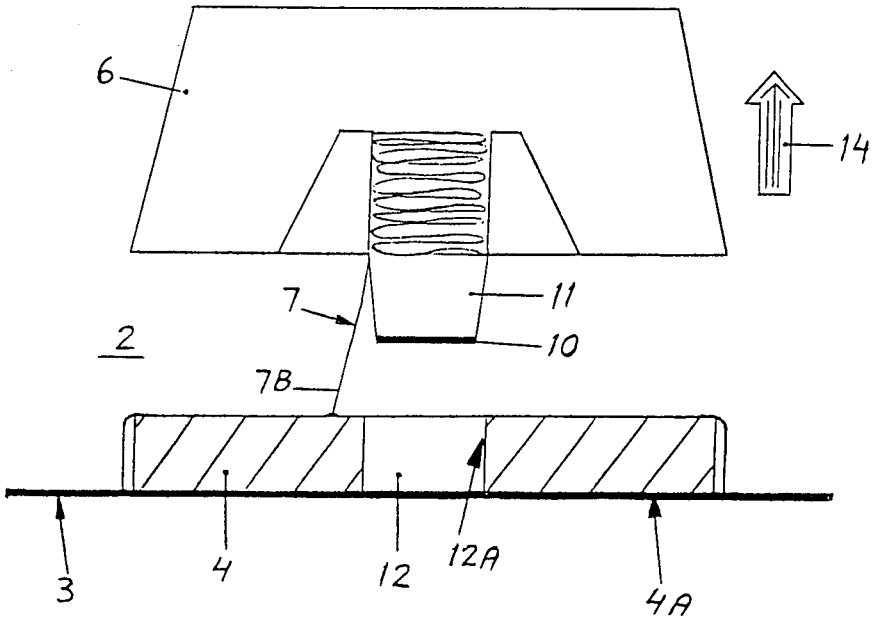
FIG. 2 shows said first variant of an indicator device in its released, active position.

The first variant of an indicator device 1, as shown in FIGS. 1 and 2, is intended primarily to be dropped into water 2 or some other fluid, thereby enabling an indication to be given of the presence of magnetisable metal object 3 or other objects which consist of a material capable of being affected by a magnet and which are completely immersed in the water 2 beneath the surface of the water. This variant is in the form of a magnet 4 which exhibits an active surface 4A capable of interacting with, and preferably capable of being attracted by or of interacting in some other way with the object 3, the presence of which it is wished to indicate, the magnet 4 most appropriately being annular and being capable of being accommodated in a holder 5 which may be open in one direction.

The indicator 1 also comprises a floating body 6 consisting of a suitable material, for example cork, plastic, wood or rubber, etc., and connected to the magnet 4 preferably by means of a line 7 attached at its respective ends 7A, 7B to the floating body 6 and the magnet 4. The line 7 may be capable of being accommodated inside a cavity 8 in the floating body 6 and may be capable of being wound around a bobbin 9.

The magnet 4 and the floating body 6 together form said indicator device 1, the joint density of which exceeds the density of the fluid 2 in which it is to be used.

At least one ejector protrusion 10, which projects with the device in its loaded position beyond said active surface 4A of the magnet 4, is present in the device 1. This protrusion 10 may most appropriately by formed by the free end of a pin 11 projecting from the floating body 6. The pin 11 is permanently attached to the floating body 6 and is capable of being accommodated in an opening 12 which fits said ejector means 10, 11, the opening 12 extending all the way through the magnet 4, although it may, as in the case of subsequently described variants, be split in a similar fashion to them. The ejector means 10, 11 together with the line bobbin 9 may appropriately form a common unit, as shown in the drawings, projecting from the inner end 8A of the cavity 8, and may consist of rubber or some other suitable material.

The ejector means 10, 11 is most appropriately arranged so as to taper conically towards its free end, in this way enabling a separable connection to be achieved between the floating body 6 and the magnet 4 through the effect of the taper against the internal generated surface 12A of the opening which is shaped to accommodate the ejector protrusion.

The function of the device 1 described above is as follows: When the device 1 is released from above into, for example, the water 2 in which it is wished to demonstrate the presence of the object 3 in question, the device 1 will sink to the bottom in the direction of the arrow 13, and because the magnet 4 functions in a similar fashion to a sinker, the active surface 4A will face essentially towards the bottom and towards the possible object 3. When the magnet 4 takes hold of the metallic object 3, for example through the influence of the attraction effect of the magnet 4, the ejector protrusion 10 will be caused by the object 3 to be pushed into the opening 12, in conjunction with which the taper effect along the outer generated surface 11A of the protrusion and the inner generated surface 12A of the opening will gradually lose its effect as the ejector means 10, 11 are pushed into the opening 12, and will eventually lose its effect altogether. The floating body 6 will then float upwards in the direction of the arrow 14 towards the surface of the water so as to indicate the presence of the object 3 which the device 1 has found and to which it has attached itself. The indication can be provided, for example, with the help of colour marking on the floating body, some kind of reflector or a radio transmitter, for instance, or by the attachment of strips of, for example, plastic or metallic material to the floating body 6, making it possible to indicate the direction in which the object 3 in question may possibly move in relation to the bottom.

Figure 3:
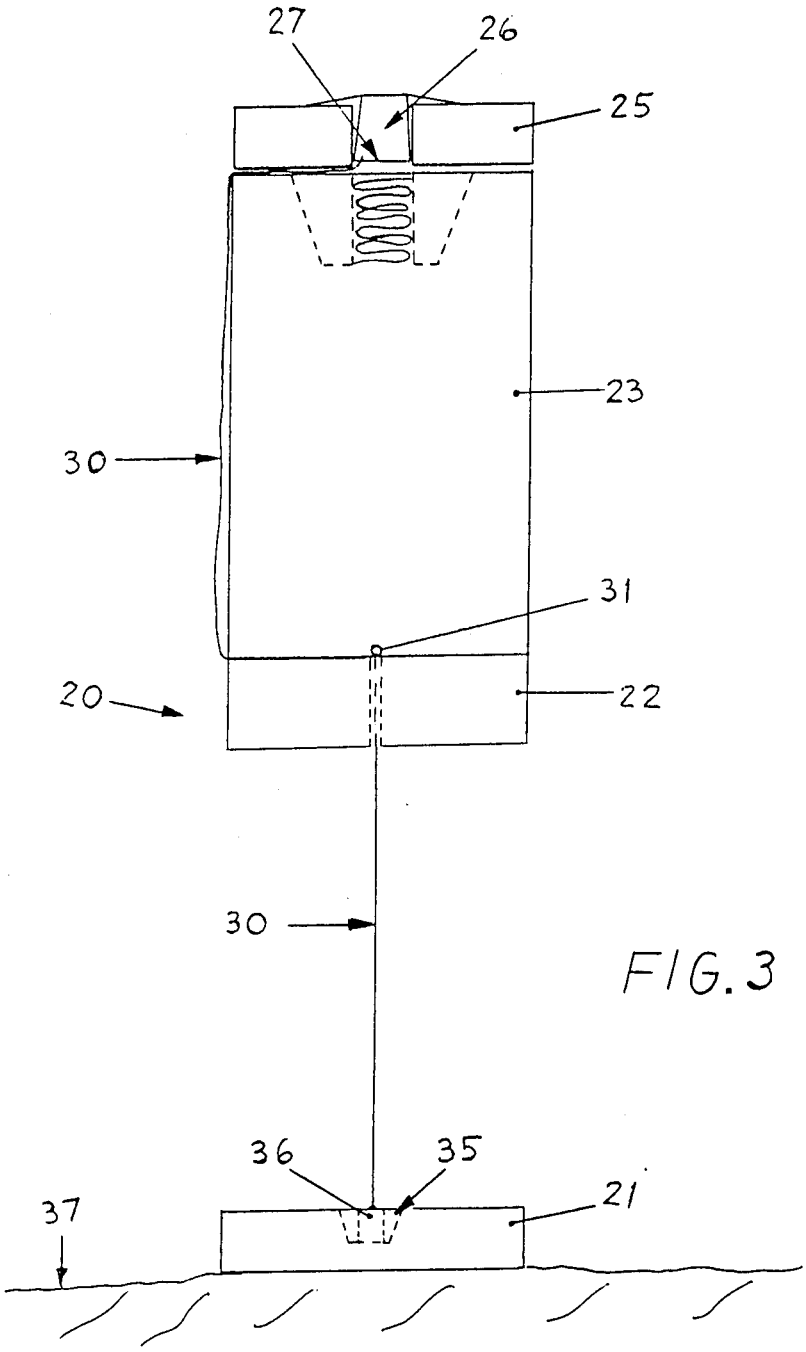
FIG. 3 shows a second variant of an indicator device so arranged as to float in the fluid in its loaded position ready for release.
Figure 4:
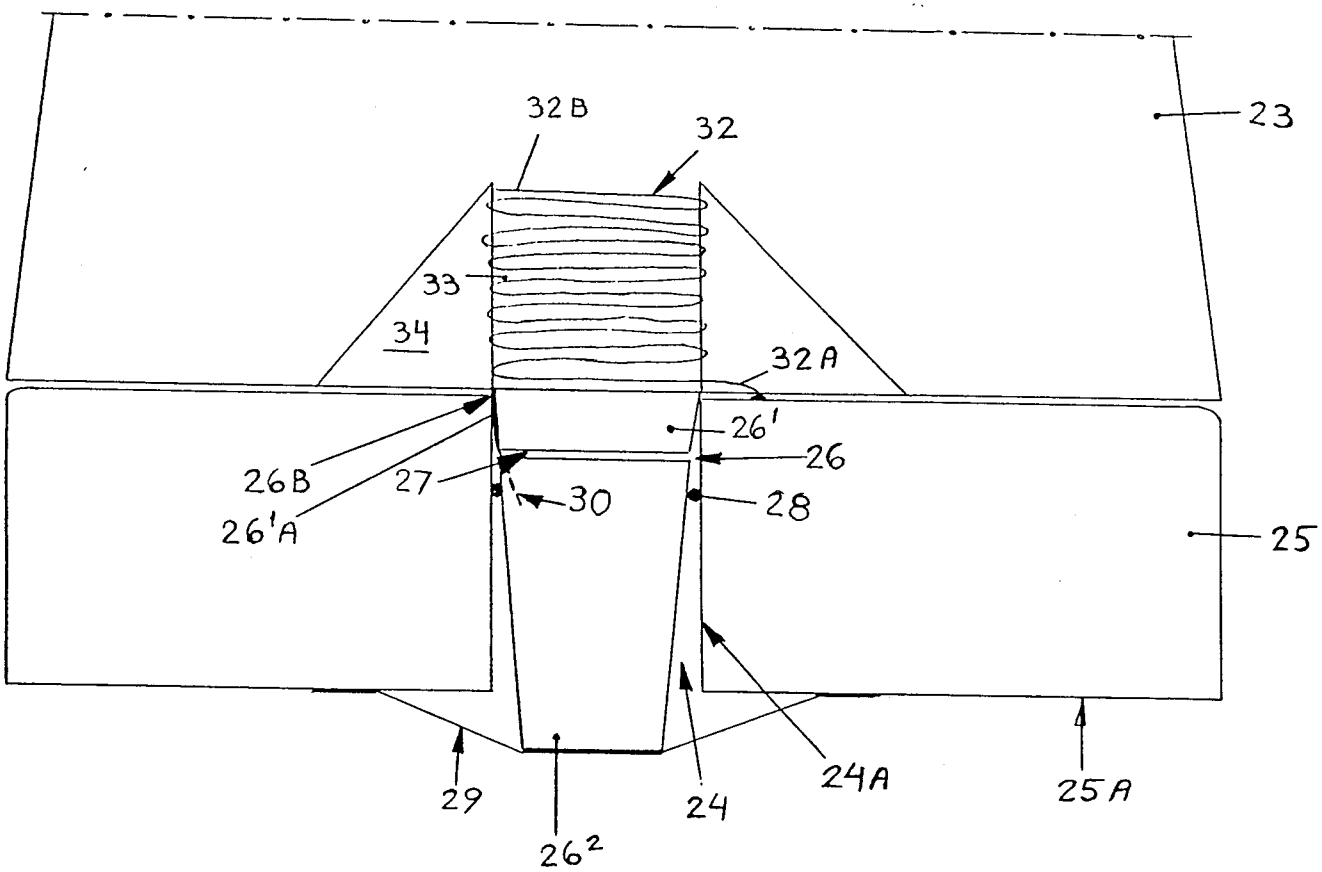
FIG. 4 shows a part of the second variant of an indicator device.

The second variant of the indicator device 20, which is shown in the drawings in FIGS. 3 and 4, is intended to work with objects which are situated at a certain distance from the surface of the bottom, and comprises a sinker 21 and a bottom weight 22, in conjunction with which a floating body 23 similar to the above is so arranged as to be capable of being separably attached. At the top, this device 20 is constructed in approximately the same way as the first variant, but with the difference that the preferably conical, pin-shaped protrusion 26 inserted in an opening 24 in a magnet 25 separably attached to the floating body 23 is split along a line 27. One part $26^1$ of said protrusion 26 is so arranged as to provide temporary adhesion of the magnet 25 to the floating body 23, for example through the taper effect, as in the first variant between the generated surfaces 24A, $26^1$A. A part $26^2$ of the protrusion which projects beyond an active surface 25A of the magnet 25 which similarly acts preferably as a magnetic attraction surface. This part constituting a prolongation of the protrusion 26, can be connected to the magnet 25 by means of, for example, an O-ring 28 and/or tape 29, or by means of a wire which is attached to the part $26^2$ of the protrusion and which can be clamped temporarily between the magnet 25 and the part $26^1$ of the protrusion. This allows the part $26^2$ of the protrusion to be pushed into the opening 24 once the magnet 25 has become attached by means of the surface 25A to a magnetisable object, and causing the part $26^1$ of the protrusion to release the floating body 23 from the magnet 25, but preventing the part $26^2$ of the protrusion from falling out of the opening 24 in the magnet 25.

From the sinker 21, there extends a line 30 which is attached to the floating body 23 and extends through a central, for instance through a transcurrent opening in the bottom weight 22 to the device 20, the line 30 being so arranged as to run through some kind of eye 31 or similar guiding point in the floating body 23 so that it is able to extend along the outside of the floating body 23. Furthermore, the line 30, being introduced into clamping means between, for example, the edge 24B of the hole in the annular magnet and the part $26^1$ of the protrusion, as shown in FIG. 4.

A line 32, which is similarly capable of being wound onto a bobbin 33 inside a hole 34 in the floating body is attached by its respective ends 32A, 32B to the magnet 25 and the floating body 23.

Also present, for example, in the sinker 21 is a central cavity 35, into which the line 30 can be wound about a central pin 36, enabling a comparatively long length of line to be stored in this component.

The function of this second variant is as follows: When the means 20, as shown in FIG. 3, is lowered into water, the sinker 21 will rest on the bottom 37 and the line 30, which is securely attached to the bottom weight 22 and which is secured in a releasable fashion to the floating body 23 through said clamping effect between the magnet 25 and the part $26^1$ of the ejector, will keep the rest of the means floating in the water at the desired level. Once the magnet 25 has become attached to an object, said line 30 will be released from the floating body 23 as a result of the interaction between the magnet 25 and the part $26^1$ ceasing following the influence of the active part $26^2$ projecting into the opening 24 and the pushing out of the fixed part $26^1$. In this case the floating body 23, which has been released from the magnet 25 and respectively from the weight 22, which falls towards the bottom 37, and from the sinker 21, which together act as a common unit, can float freely up to the surface of the water and is thus able to indicate the presence of the object in the same way as in the first variant. The line 32 connects the floating body 23 to the magnet 25 in this case. Thanks to the division of the ejector pin 26, the part $26^1$ is caused to be fully released from the magnet 25, which would not otherwise have been possible.

Figure 5:
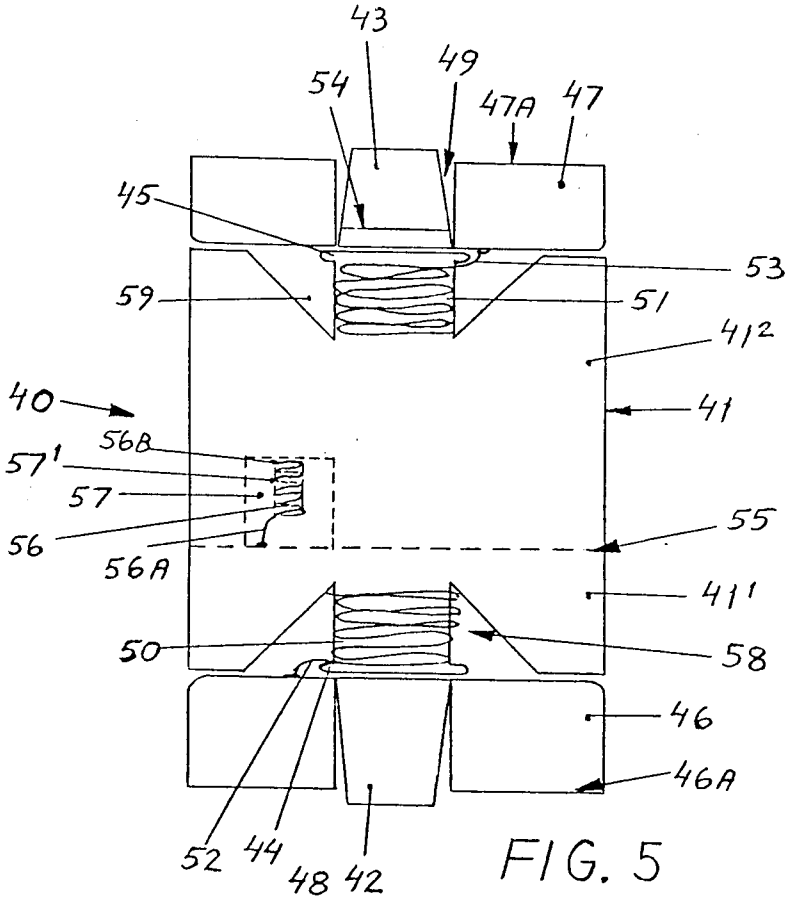
FIG. 5 shows a third variant of an indicator device which is so arranged as to be activated in two directions.

The variant of the device 40 shown in FIG. 5 represents a combination of the two previous variants 1 and 20, that is to say that it exhibits the ability to attach itself to the object in question in both the upward and the downward sense, this characteristic being advantageous, among other things, if one has missed the object while lowering the device into the water, since the device 40 will then lie on the bottom and will exhibit the ability to attach itself to an object which passes over it close to the bottom.

The device 40 is provided with two pins 42, 43 each projecting in its own direction from a floating body 41 and acting as ejector protrusions, the pins facing essentially upwards and downwards respectively in the primed position. A flange 44, 45 is most appropriately arranged on the pins 42, 43 in the area immediately behind the two annular magnets 46 and 47, where these are so arranged as to be held separably in a manner similar to the above through the interaction between the pins 42, 43 and the matching transcurrent openings 48 and 49 in the magnets 46, 47, the ejector pins then proceeding to serve as line bobbins 50 and 51 for a line 52 and 53 connected respectively to each magnet 46, 47 and to the floating body 41. The flanges 44, 45 prevent the lines 52, 53 from becoming trapped between the respective pins 42, 43 and the magnets 46, 47. Similar flanges to prevent trapping may, of course, be provided in the other typical embodiments of the indicator device 1, 20 specified and illustrated here. The annular magnet 46 is heavier than the annular magnet 47, and the device 40 is so adjusted that the combined mass of the magnets 46, 47 is greater than the buoyancy of the floating body 41, so that the entire device 40 will sink after having been dropped into the water. The buoyancy of the floating body is, on the other hand, greater than the mass of the sinker body acting as the secondary magnet 46, so that said floating body 41 with the magnet 46 suspended from it will be able to float up to the surface after having been separated from the magnet 47. In this embodiment, too, the upper pin 43 is split along a plane 54 so as to achieve the same effect as in the second embodiment, and so that the floating body 23 with the magnet 46 suspended from it shall easily be able to leave the magnet 47 once the latter has attached itself to, for example, the underside of an object of the kind in question in a previously illustrated fashion.

The floating body 41 is appropriately divided along the plane 55 so as to form two separate parts $41^1$ and $41^2$ of the floating body, which are connected to each other by fastening means, for example a water-soluble adhesive or some other releasable medium. A line 56, which is attached at its respective ends 56A, 56B to each of the parts $41^1$, $41^2$ of the floating body, may be capable of being wound onto a bobbin $57^1$ accommodated inside a space 57 in one of the parts $41^2$ similar to the spaces 58 and 59 intended for the bobbins 50 and 51.

The two parts $41^1$ and $41^2$ of the floating body situated to either side of the division 55 are appropriately so arranged as to exhibit a different buoyancy in relation to one another, that is to say that the upper part $41^2$ of the floating body exhibits greater buoyancy than the mass of the upper magnet 47 and than the lower part $41^1$ of the floating body. This means that the two parts $41^1$ and $41^2$ will be released from one another and that the part $41^2$ will float up to the surface after having been divided along the plane 55 after the period taken, for example, by the water-soluble adhesive to dissolve in the water. The lower part $41^1$ exhibits a buoyancy which is less than the mass of the magnet 46, which means that the magnet 46 will remain on the bottom together with the part $41^1$ of the body.

The function of the third embodiment is as follows: When the device 40 is released into the water, the heavier magnet 46 will attach itself by its active surface 46A to the object in question situated beneath it, whereupon the floating body 41 with the magnet 47 suspended from it after having been released from the magnet 46 will float up to the surface in a fashion similar to that already described and will remain anchored there to the magnet 46 and the object via the line 52, enabling the position of the object in the water to be indicated. Should the object have been missed, then the entire device 40 will drop to the bottom and will lie there with the active surface 47A of the magnet 47 facing upwards until such time as some object approaches its upper surface. When the magnet 47 is attracted by said object and attaches itself to its under side, for example, the magnet 47 will be released from the remainder of the device 40, in which case said remainder will float up as a whole, enabling the presence of the object to be indicated by being connected to same via the line 53.

If, however, the device 40 were to remain on the bottom without finding any object, then division would gradually take place along the plane 55 once the water-soluble adhesive had been dissolved and its holding effect had ceased, which means that the part $41^2$ of the floating body with the magnet 47 suspended from it will float up to the surface moored to the part $41^1$ of the floating body and the lower magnet 46 via the line 56. The part $41^2$ of the floating body will thus mark at the surface of the water the point where the rest of the means is situated, and the entire means can be recovered and re-assembled for re-use. It is thus a simple matter to retrieve the other unused indicator means 1, 20, 40 specified here, since these floating bodies 6, 23 can also be divided and connected together in the manner indicated above, thereby providing them with a similar function.

Figure 6:
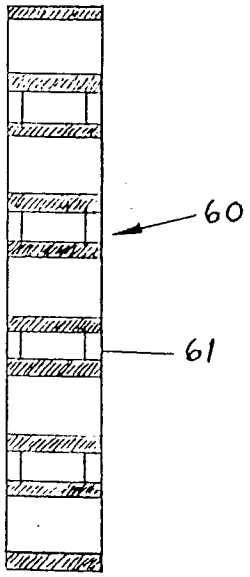
FIG. 6 shows a stack of stored indicator devices.

FIG. 6 shows how indicator means can be packed into a compact unit 60, for example into a tube 61.

The invention is not restricted to the typical embodiments specified above and illustrated in the drawings, but may be modified within the scope of the following Patent Claims without departing from the idea of invention.

I claim:

1. A device for indicating the presence of a magnetically responsive object submerged in a fluid, comprising magnet means having an active surface to contact said object, a floating body, means coupling said floating body to said magnet means, said magnet means and at least one ejector protrusion extending beyond said active surface for deactivating said coupling means when said protrusion is moved by attraction between said object and said magnet means.

2. A device in accordance with claim 1, characterized by a line accommodated inside a cavity in the floating body and wound around a bobbin.

3. A device in accordance with claim 2, characterized in that the magnet means is provided with a transcurrent opening to accommodate the ejector protrusion, wherein said magnet means is in the form of an annular magnet.

4. A device in accordance with claim 2, characterized in that the floating body is connected to a sinker body, separate from the magnet means, being connected by means of a connecting line.

5. A device in accordance with claim 1, characterized in that the magnet means is formed from a body exhibiting a transcurrent opening to accommodate the ejector protrusion.

6. A device in accordance with claim 5, characterized in that the magnet means is accommodated in a holder open in one direction.

7. A device in accordance with claim 6, characterized in that the ejector protrusion is conical and is so arranged so to extend in the direction from the floating body passing through the opening for accommodating an ejector and is capable of interacting by at least one part with the magnet means to provide a temporary holding of the magnet means to the floating body.

8. A device in accordance with claim 6, characterized in that the floating body is connected to a sinker body, separate from the magnet means, being connected by means of a connecting line.

9. A device in accordance with claim 5, characterized in that the ejector protrusion is conical and is so arranged as to extend in the direction from the floating body passing through the opening for accommodating the ejector and is capable of interacting by at least one part with the magnet means for providing temporary holding of the magnet means to the floating body.

10. A device in accordance with claim 9, characterized in that the protrusion is split to form a number of protrusion component parts, and including securing means for connecting one of the projecting protrusion component parts in a releasable fashion to the magnet means, said securing means being accommodated in said opening with one protrusion component part projecting beyond said active surface serving as an attraction surface.

11. A device in accordance with claim 1, characterized in that the floating body is releasably connected to a sinker body, separate from the magnet means, and line means coupling said sinker body to said magnet means.

12. A device in accordance with claim 9, characterized in that the floating body is connected to a sinker body, separate from the magnet means, being connected by means of a connecting line.

13. A device in accordance with claim 3, characterized in that the floating body is connected to a sinker body, separate from the magnet means, being connected by means of a connecting line.

14. A device in accordance with claim 1, characterized in that said magnet means comprises two separate magnets coupled to the floating body, one on either side of the floating body, one of said magnets being a secondary magnet and exhibiting a greater mass than the other magnet, and in that the buoyancy of the floating body is greater than the mass of the secondary magnet.

15. A device in accordance with claim 1, characterized in that the floating body is split and includes two component parts releasably connected to one another by fastening means, said parts of the floating body being connected to one another by means of a line.

16. A device in accordance with claim 1, characterized in that between the magnet means and the floating body, there is arranged a connecting means accommodated inside a cavity in the floating body and capable of being wound around a bobbin.

17. A device in accordance with claim 1, characterized in that the magnet means is provided with a transcurrent opening to accommodate the ejector protrusion, an annular magnet which exhibits a central opening.

18. A device in accordance with claim 10, characterized in that the floating body is connected to a sinker body, separate from the magnet means, being connected by means of a connecting line.

* * * * *